US008205721B2

(12) United States Patent
Korhonen et al.

(10) Patent No.: US 8,205,721 B2
(45) Date of Patent: Jun. 26, 2012

(54) ARRANGEMENT AND METHOD FOR CONTROLLING THE BRAKE OF AN ELEVATOR USING DIFFERENT BRAKE CURRENT REFERENCES WITH DIFFERENT OPERATION DELAYS

(75) Inventors: Tuukka Korhonen, Helsinki (FI); Asmo Tenhunen, Hyvinkää (FI); Petri Alkula, Hämeenlinna (FI); Mika Olkkonen, Hyvinkää (FI); Jussi Huppunen, Vantaa (FI); Jyrki Laaksonheimo, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/198,769

(22) Filed: Aug. 5, 2011

(65) Prior Publication Data

US 2011/0308894 A1 Dec. 22, 2011

Related U.S. Application Data

(63) Continuation of application No. PCT/FI2010/050048, filed on Jan. 28, 2010.

(30) Foreign Application Priority Data

Feb. 6, 2009 (FI) ..... 20090038

(51) Int. Cl.
*B66B 1/32* (2006.01)

(52) U.S. Cl. ..... 187/288; 187/393

(58) Field of Classification Search ..... 187/247, 187/277, 281, 286, 287, 288, 289, 391–393
See application file for complete search history.

(56) References Cited

U.S. PATENT DOCUMENTS

| | | | | | |
|---|---|---|---|---|---|
| 3,741,348 | A * | 6/1973 | Caputo | 187/284 |
| 3,917,029 | A * | 11/1975 | Maynard | 187/288 |
| 4,493,398 | A * | 1/1985 | Kindler | 187/296 |
| 5,077,508 | A * | 12/1991 | Wycoff et al. | 318/436 |
| 5,157,228 | A * | 10/1992 | Ackermann et al. | 187/247 |
| 5,247,140 | A * | 9/1993 | Iwasa et al. | 187/288 |
| 6,802,395 | B1 | 10/2004 | Helstrom et al. | |
| 7,740,110 | B2 * | 6/2010 | Kattainen et al. | 187/288 |
| 7,921,696 | B2 * | 4/2011 | Takao et al. | 73/61.52 |
| 7,992,689 | B2 * | 8/2011 | Stolt et al. | 187/393 |
| 2011/0278099 | A1 * | 11/2011 | Kattainen et al. | 187/288 |

FOREIGN PATENT DOCUMENTS

| | | | |
|---|---|---|---|
| JP | 04-153174 | A | 5/1992 |
| JP | 07-206288 | A | 8/1995 |
| JP | 2008-120469 | A | 5/2008 |
| JP | 2008-120521 | A | 5/2008 |

* cited by examiner

*Primary Examiner* — Anthony Salata
(74) *Attorney, Agent, or Firm* — Birch, Stewart, Kolasch & Birch, LLP

(57) ABSTRACT

A method and an arrangement for controlling a brake of an elevator. In the method a plurality of optional objectives of operation are determined for the elevator; one or more of these objectives is selected at a time to be implemented as an objective of the operation of the elevator by using selection criterion; references for the energizing current of the brake of the elevator that differ from each other and/or references for the closing current of the brake of the elevator that differ from each other are determined; the brake current reference used at any given time is selected so that the selected brake current reference best corresponds to an objective of the operation of the elevator to be implemented; and also the brake of the elevator is controlled by adjusting the brake current towards the selected brake current reference.

20 Claims, 4 Drawing Sheets

Figure 1:
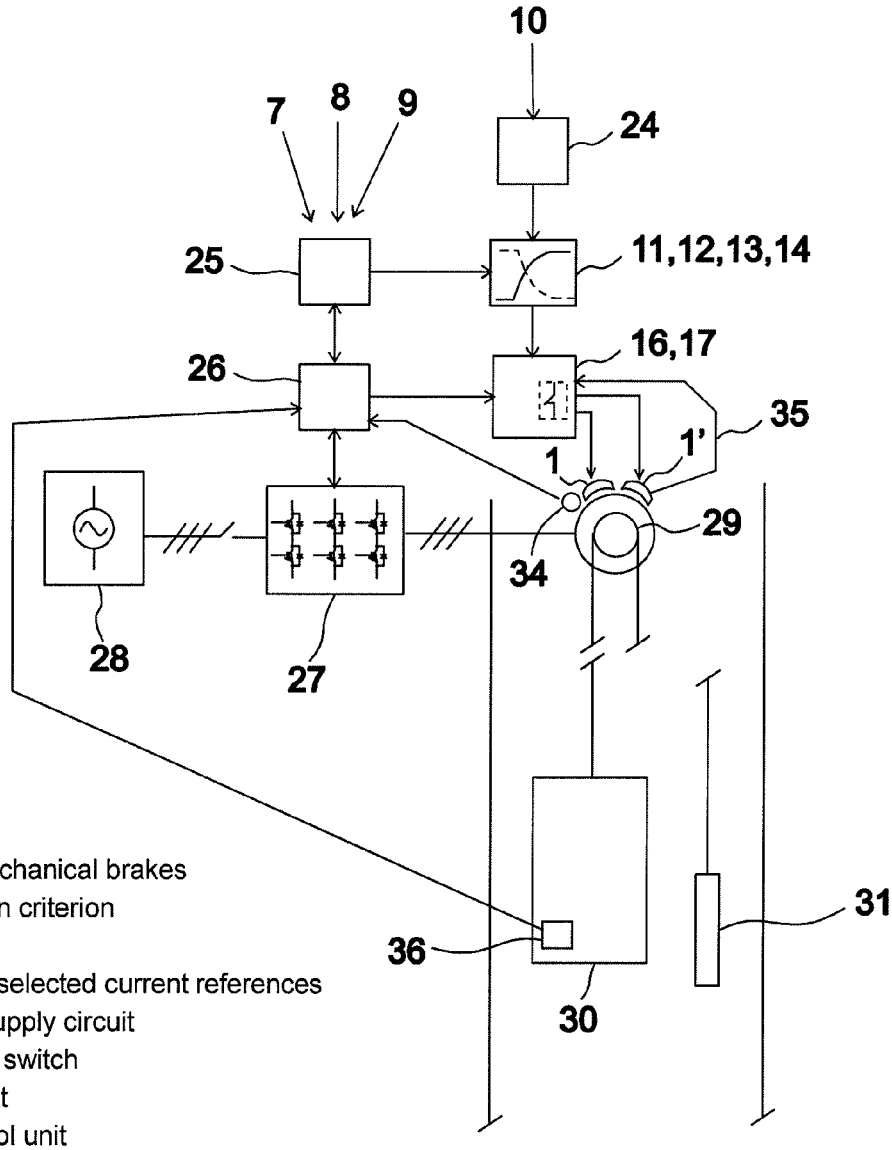

1, 1': electromechanical brakes
7, 8, 9: selection criterion
10: status data
11, 12, 13, 14: selected current references
16: electricity supply circuit
17: controllable switch
24: safety circuit
25: group control unit
26: control unit
27: frequency converter
28: electricity network
29: traction sheave
30: elevator car
31: counterweight
34: encoder
35: measured brake current
36: load-weighing sensor 1: electromechanical brake
15: excitation winding
16: electricity supply circuit
41, 41': helical springs
42: brake pad
43: air gap
44, 44': ferromagnetic parts
45: braking surface
46: microcontroller 3, 4, 5, 6: optional objectives of operation
3', 4', 5', 6': implemented objectives of operation
7, 8, 9: selection criterion
11, 12, 13, 14: selected current references

ARRANGEMENT AND METHOD FOR CONTROLLING THE BRAKE OF AN ELEVATOR USING DIFFERENT BRAKE CURRENT REFERENCES WITH DIFFERENT OPERATION DELAYS

CROSS REFERENCE TO RELATED APPLICATIONS

This application is a Bypass Continuation of PCT International Application No. PCT/FI2010/050048 filed on Jan. 28, 2010, which claims priority under 35 U.S.C. 119 (a) to Patent Application No. 20090038 filed in Finland, on Feb. 6, 2009. The entire contents of all of the above applications is hereby incorporated by reference.

The present invention relates to a method for controlling the brake of an elevator as defined in the preamble of claim 1, and also to an elevator system as defined in the preamble of claim 10.

Elevators generally comprise a holding brake, which is used to keep the elevator car in its position when the car is stopped at a floor level. This same brake is often used also as an emergency brake as required by elevator regulations, which brake is switched on in exceptional situations, such as during an electricity power cut. A drum brake or a disc brake, for example, can be used as a brake.

The brake of the elevator operates normally such that when the brake is closed, the spring comprised in the active part of the brake presses the brake shoe and the brake pad connected to it against the braking surface comprised in the rotating part of the machine, in which case the elevator car stays in its position. During a run, current is connected to the electromagnet comprised in the active part of the brake and the magnet pulls the brake shoe and the brake pad off the braking surface, in which case the brake is open, i.e. energized, and the elevator car can move up or down in the elevator hoistway. The brake implementation of the elevator can be e.g. such that the implementation comprises two brakes, both of which are fitted to connect mechanically to the same braking surface.

The active force when the brake closes is generally quite large, owing to which the operation of the brake produces a lot of kinetic energy. This produces a loud noise when the brake pad hits against the braking surface. To solve this problem the aim has been for the distance between the brake pad and the braking surface to be as small as possible. In this case the brake pad does not have time to achieve a very great speed and kinetic energy when it hits closed, as a result of which the impact is more subdued. An air gap that is small enough is, however, difficult to implement and also to adjust, and this type of solution results in a very fragile structure and also in extremely precise manufacturing tolerances.

The operation of the brake of the elevator can be affected also be adjusting the current of the brake. Publication JP 2008120521 presents one such type of adjustment of the brake current wherein the braking force is measured from the brake drum with a special pressure sensor, and the current of the excitation winding of the brake is adjusted on the basis of the measuring signal of the pressure sensor. In this case the braking force can be affected with the adjustment of the brake current.

Publication JP 2008120469 presents an arrangement wherein it is endeavored to reduce the noise produced by the operation of the brake by changing the impedance of the electricity supply circuit of the brake in stages such that the change in impedance also affects the magnitude of the brake current.

The purpose of this invention is to solve the aforementioned drawbacks as well as the drawbacks disclosed in the description of the invention below. In this case the control of a brake of an elevator is presented as an invention, which adapts quickly to the different operating situations of the elevator so that the level of operation of the elevator system improves.

The method for controlling the brake of an elevator according to the invention is characterized by what is disclosed in the characterization part of claim 1. The elevator system according to the invention is characterized by what is disclosed in the characterization part of claim 10. Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

In the method according to the invention for controlling the brake of an elevator, a plurality of optional objectives of operation are determined for the elevator; one or more of these objectives is selected at a time to be implemented as an objective of the operation of the elevator by using selection criterion; references for the energizing current of the brake of the elevator that differ from each other and/or references for the closing current of the brake of the elevator that differ from each other are determined; the brake current reference used at any given time is selected so that the selected brake current reference best corresponds to an objective of the operation of the elevator to be implemented; and also the brake of the elevator is controlled by adjusting the brake current towards the selected brake current reference. The objectives of the operation of the elevator vary according to, among other things, the time of use, e.g. the time of day/night, such that during certain periods of time objectives of the operation of the elevator related to the handling of traffic flow are weighted; e.g. during peak traffic the duration of a run of the elevator, i.e. minimization of the so-called door-to-door time is important. On the other hand, however, during off-peak traffic, such as in the night-time, objectives can be favored that according to which the noise produced by operation of the elevator decreases. Thus to minimize door-to-door time the brake current reference of the elevator can be selected e.g. so that the energizing delays and/or closing delays of the brake shorten. When the delays shorten and the movement of the brake speeds up, the noise produced by the operation of the brake increases however. For this reason the brake current reference can during times of off-peak traffic be selected so that the brake is quieter, even though the operating delay of the brake is in this case longer. The selection of the brake current reference can be made e.g. by means of a cost function. When the brake current reference is thus repeatedly re-selected when the objective of the operation of the elevator changes, also the control of the brake of the elevator is better fitted according to changing operating conditions.

The most important of the objectives of the operation of the elevator is ensuring operating safety, for which reason also the selection criteria of the objective of the operation of the elevator determining the operating safety of the elevator receive the greatest weighting. These types of selection criteria that determine operating safety relate both to normal operation of the elevator and also to use of the elevator during different installation jobs and servicing jobs. In one embodiment of the invention the status data received from the safety circuit of the elevator is used as one selection criterion of an objective of the operation of the elevator, which status data determines the operation of the safety-critical parts of the elevator. In one embodiment of the invention an electronic control unit is fitted to the safety circuit of the elevator, which control unit is fitted to read the safety sensors of the elevator system and to determine the status data of the elevator on the basis of the information read from the safety sensors. The aforementioned safety sensors of the elevator system are e.g. the safety switches of the landing doors, the end limit switches of the elevator hoistway, and also the safety switch of the overspeed governor. The electronic control unit can be arranged to be redundant, in which case the control is duplicated e.g. with two microcontrollers that monitor the operating status of each other.

Other optional objectives of the operation of the elevator are e.g. ensuring the continuity of use of the elevator, preventing overloading of elevator components, and also reducing the energy consumption of the elevator.

In one embodiment of the invention the current of the excitation winding of the brake is measured; and also the measured current is adjusted towards the current reference for the excitation winding by connecting a controllable switch in the electricity supply circuit of the brake with short pulses. The aforementioned controllable switch can be a mechanical switch, e.g. a relay and a contactor, and it can also be a solid-state switch, e.g. an IGBT transistor, MOSFET transistor, thyristor and bipolar transistor. In one embodiment of the invention at least one controllable switch of the electricity supply circuit of the brake is fitted in connection with the safety circuit of the elevator.

In one embodiment of the invention the first reference for the energizing current of the brake is determined so that the reference for energizing current is during the energizing movement at least a part of the time greater than when the energizing movement starts; and also the second reference for the energizing current of the brake is determined so that the reference for energizing current is during the whole time of the energizing movement smaller than when the energizing movement starts. The movement equation of the brake pad and brake shoe is determined on the basis of the force balance between the thrusting means, such as a spring or corresponding, that presses them against the braking surface and also the electromagnet that pulls the aforementioned brake pad and brake shoe off the braking surface. When the current of the excitation winding of the brake is increased in stages, the attraction of the electromagnet increases, in which case the force produced by the aforementioned energizing current finally detaches the brake pad from the braking surface. When the first reference for the energizing current is determined during the energizing movement so that the reference is during the energizing movement at least a part of the time greater than when the energizing movement starts, the force that during the energizing movement acts on the brake shoe and on the brake pad also increases, in which case the brake energizes more quickly. Correspondingly, when the second reference for energizing current is determined to be smaller for the whole time of the energizing movement than when the energizing movement starts, also the force producing the movement decreases, and the brake operates more slowly. The energizing movement occurs in this case despite the decrease in energizing current, because the force produced by the energizing current increases as a function of the energizing movement, in which case as the energizing movement continues also a smaller current is sufficient to overcome the thrusting force produced by the thrusting means. As the energizing force decreases, the noise produced by the energizing movement also decreases.

In one embodiment of the invention the first reference for the closing current of the brake is determined so that the reference for closing current is during the closing movement at least a part of the time smaller than when the closing movement starts; and also the second reference for the closing current of the brake is determined so that the reference for closing current is during the whole time of the closing movement greater than when the closing movement starts. The closing movement of the brake starts when the current of the excitation winding of the energized brake decreases sufficiently. In this case the brake shoe and the brake pad start to move towards the braking surface of the rotating part of the machine. The force that moves the brake shoe and the brake pad after detachment of the brake pad increases as the closing current decreases. In this case when the reference for closing current is during the closing movement at least a part of the time smaller than when the closing movement starts, the brake also closes faster. Correspondingly, when the reference for closing current is greater during the time of the closing movement than when the closing movement starts, also the force producing the movement decreases, and the brake closes more slowly. The closing movement occurs despite the increase in closing current, because the force caused by the closing current preventing the movement decreases as a function of the closing movement. In this case, therefore, a greater closing current is needed as a function of the closing movement to achieve a reduction in the effect of the thrusting force produced by the thrusting means. As the closing current increases the noise of the brake also decreases, because the noise that is produced when the brake shoe and brake pad hit against the braking surface decreases as the closing movement slows down.

In one embodiment of the invention the operating delay of the brake according to the second reference for brake current is fitted to be longer than the operating delay according to the first reference for brake current.

In one embodiment of the invention a third reference for brake current is determined; and also the operating delay of the brake according to the third reference for brake current is fitted to be longer than the operating delay according to the second reference for brake current.

When a number of brake current references with operating delays are determined, the operating delay to be used at any given time can be selected more versatilely for the operation of the elevator according to the objectives set at the time of selection, in which case the accuracy of operation improves.

In one embodiment of the invention the determined loading of the elevator is used as one selection criterion of an objective of the operation of the elevator. The imbalance position of the loading causes the torque requirement of the elevator motor and at the same time also the current of the elevator motor to increase. Owing to the long operating time of the brake, it is necessary to keep the elevator car in its position in the elevator hoistway with the torque of the motor in connection with stopping, and sometimes also with starting, the elevator to overcome the imbalance. In this case the supply current of the motor is, from the viewpoint of the frequency converter, essentially direct current. The ability of the frequency converter to handle direct current is typically poor, because repeated direct current stress of long duration causes, among other things, cyclical thermal expansion in the power switches, such as in the IGBT transistors and in the diodes, which shortens the lifetime of the components. In this case, according to the invention, the objective of the operation of the elevator can in connection with a great imbalance position be selected such that the current stress of the frequency converter caused by the imbalance position of the loading of the elevator decreases. This is achieved by shortening the duration of the direct current, e.g. by selecting a current reference for the brake such that the operating delay of the brake is minimized. A shortened duration of the direct current also reduces the energy consumption of the elevator to some extent.

When the brake current reference is selected according to an objective of the operation of the elevator with the elevator control system, and when, on the other hand, also the switching on and/or switching off of the current of the frequency converter is controlled using the elevator control system, the switching on and/or switching off of the frequency converter can be timed to correspond to the operating delay of the brake according to the selected brake current reference, in which case the starting delays and/or stopping delays of the elevator are minimized.

Figure 2:
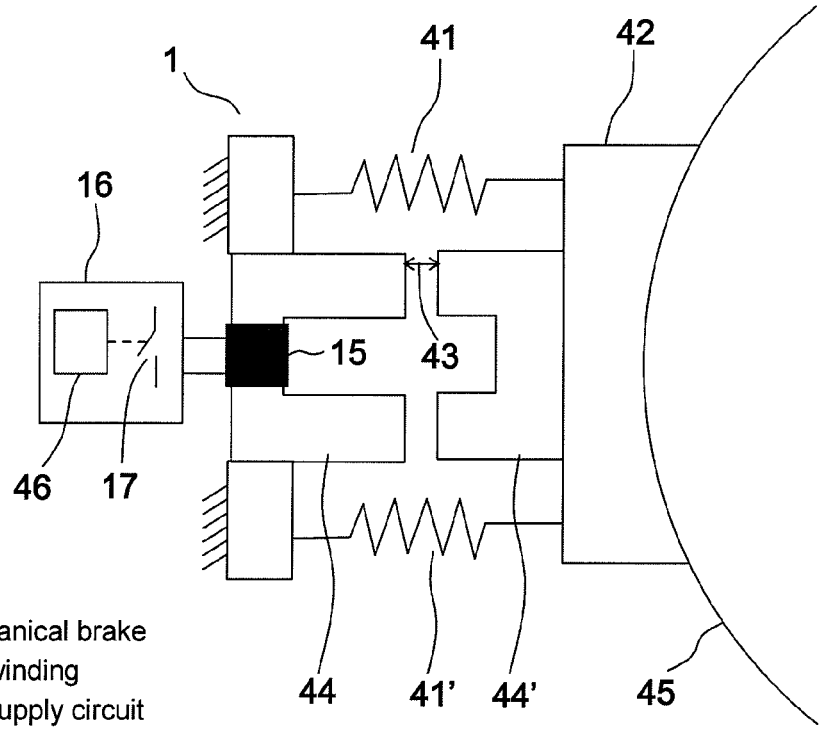
Figure 3A:
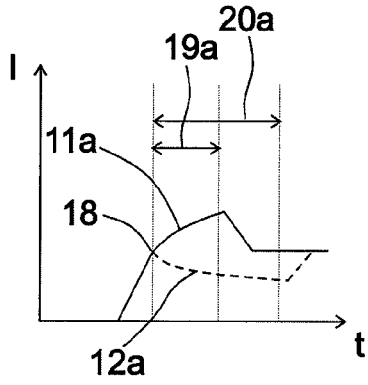
Figure 3B:
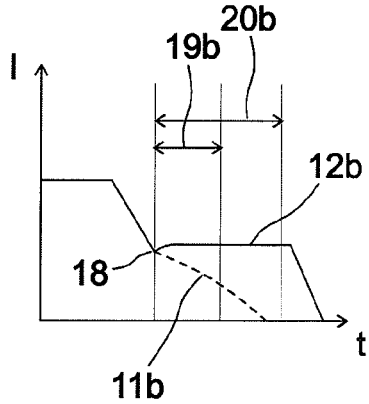
Figure 4A:
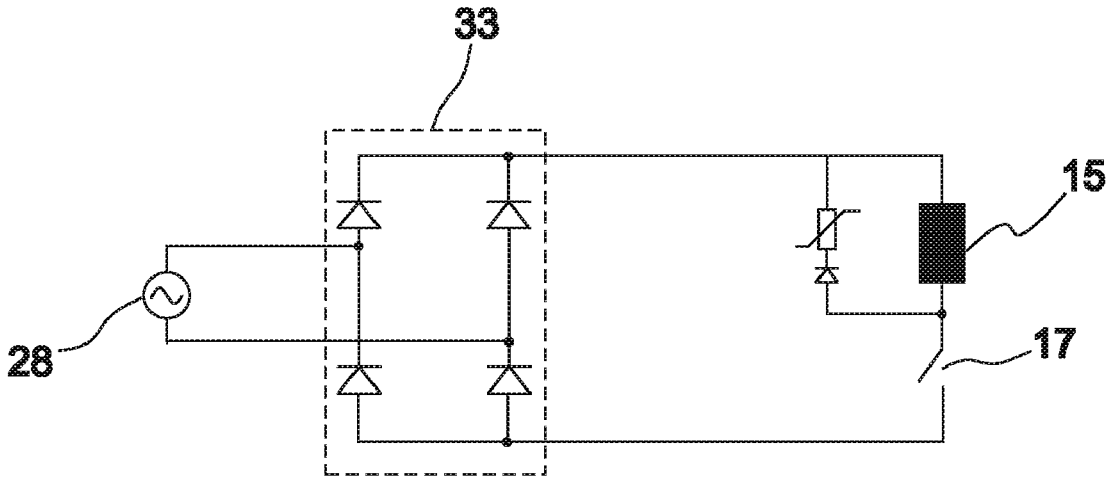
Figure 4B:
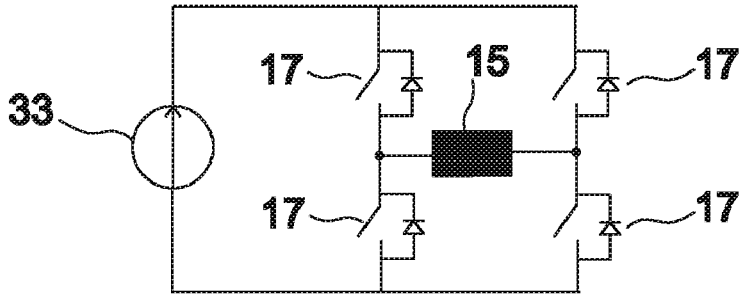
Figure 5:
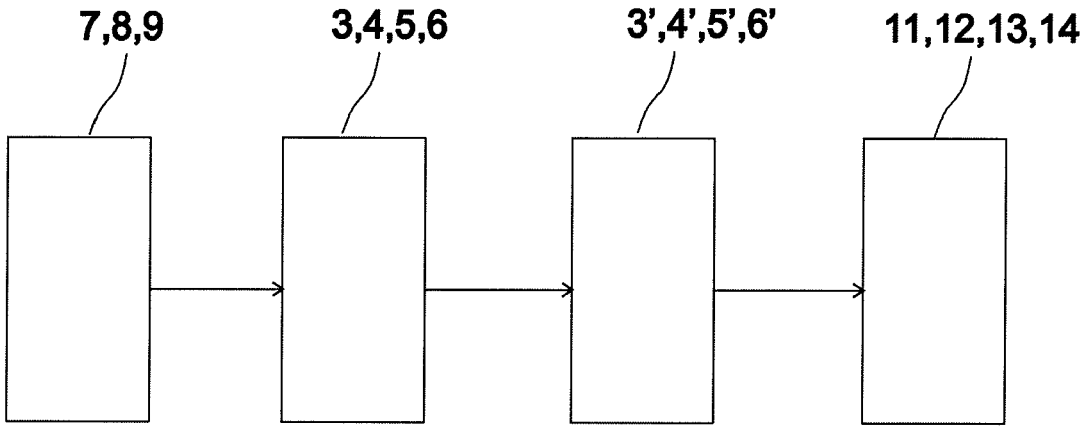

In the following, the invention will be described in more detail by the aid of some examples of its embodiments, which in themselves do not limit the scope of application of the invention, with reference to the attached drawings, wherein FIG. 1 presents one elevator system according to the invention FIG. 2 presents a schematic diagram of one brake according to the invention FIG. 3 presents some brake current references according to the invention FIGS. 4*a*, 4*b* present some electricity supply circuits of a brake according to the invention FIG. 5 presents one selection of a brake current reference according to the invention as a to block diagram In the elevator system according to FIG. 1, the elevator car 30 and the counterweight 31 are supported with elevator ropes passing via the traction sheave 29 of the elevator machine. The traction sheave is integrated into the rotor of the elevator machine. The operation of the elevator system is controlled with the control system of the elevator system. A communication connection is arranged between the different control units of the elevator system. The structure of this type of series mode communications channel is in itself prior art, and it is not presented here in more detail. The power supply of the elevator motor that moves the elevator car occurs from the electricity network 28 with a frequency converter 27. A permanent-magnet synchronous motor is used here as the elevator motor. The control unit 26 of the movement of the elevator car comprises a control loop, in which the speed of the traction sheave of the elevator motor is measured with an encoder 34. The current to be supplied to the elevator motor is adjusted with the frequency converter 27 such that the measured speed of the traction sheave adjusts to correspond to the reference value for speed. The aforementioned reference value for speed is calculated as a function of the position of the elevator car moving in the elevator hoistway. The control apparatus of the elevator system also comprises a group control unit 25 of the elevator system, with which among other things the elevator calls to be served are allocated according to the allocation criteria used at any given time. The control apparatus of the elevator system also comprises a safety circuit, which comprises different safety devices, by means of which the safety of the elevator system is ensured both during normal operation and also in different exceptional operating situations and malfunction situations. These types of safety devices are e.g. the brake control unit 16, 17 of the elevator machine, the supervision unit for overspeed of the elevator car, and also the supervision unit (not in figure) for the position of the landing doors.

Two electromechanical brakes 1, 1', which both connect to the braking surface of a rotating part to prevent movement of the traction sheave, are fitted in connection with a rotating part of the elevator machine. Control of the brake occurs by supplying brake current to the excitation winding 15 of both brakes from the electricity supply circuit 16 of the brake. The electricity supply circuit also comprises a control loop for adjusting the brake current. The measured brake current 35 is adjusted towards the brake current reference 11, 12, 13, 14 by connecting a controllable switch 17 in the electricity supply circuit of the brake with short pulses.

A plurality of optional objectives of operation is determined for the elevator system. These objectives are connected to e.g. minimizing the door-to-door time of the elevator 3, reducing the noise produced by operation of the elevator 4, ensuring the continuity of use of the elevator, preventing overloading of elevator components 5, and also reducing the energy consumption of the elevator 6. The group control unit 25 of the elevator selects one or more of these at a time to be implemented as an objective 3', 4', 5', 6' of the operation of the elevator using selection criterion 7, 8, 9.

The safety circuit 24 of the elevator implements the most important objective of the operation of the elevator, ensuring the safety of the elevator system. For this reason the safety circuit 24 generates status data 10, which determines the operation of the safety-critical parts of the elevator system. The status data 10 of the safety circuit always overrides the other selection criterion 7, 8, 9 of an objective of the operation of the elevator in the sequence if priority.

The arrangement for controlling the brake of the elevator comprises brake current references 11, 12, 13, 14 that differ from each other. The brake current reference 11, 12, 13, 14 used at any given time is selected so that the selected brake current reference best corresponds to an objective 3', 4', 5', 6' of the operation of the elevator to be implemented. Since the brake of the elevator is also controlled by adjusting the brake current towards the selected brake current reference 11, 12, 13, 14, the brake control of the elevator is also in this case according to the objective of the operation of the elevator.

The group control unit 25 of the elevator receives information about the magnitude 8 of the traffic flow of the elevator by means of, among other things, landing calls, car calls, the load weighing device, as well as by means of different access control apparatuses placed on the route of elevator passengers. The magnitude of the traffic flow is also determined e.g. on the basis of the time of use 7 of the elevator such that e.g. in office buildings the volume of elevator passengers can be assumed to be at its greatest at certain times during a 24-hour period, such as in the morning and afternoon; the traffic flow can also be quieter e.g. during holiday months. The group control unit 25 selects the reference for energizing current of the brake and/or for the closing current of the brake to be used at any given time e.g. such that during heavy traffic flow the operating delay of the brake according to the selected brake current reference is as short as possible, to minimize the door-to-door time of the elevator. During quieter traffic flow, and more particularly at night-time, it is endeavored to reduce the noise produced by operation of the elevator system by selecting a brake current reference 11, 12, 13, 14 to be used at that time, according to which the operating delay of the brake is longer, in which case the noise produced by the operation of the brake is also quieter.

The control unit 25 of the movement of the elevator car reads the load-weighing sensor 36 of the elevator car, which sensor determines the loading 7 of the elevator system, and controls with the frequency converter 27 the current to the motor on the basis of the loading data such that the current of the motor increases as the imbalance of the loading increases. When the elevator stops at a floor level the elevator car is held in its position in the elevator hoistway with the elevator motor until the machinery brake of the elevator has closed and locked the traction sheave in its position. In this case if the imbalance position of the loading is great, the frequency converter supplies direct current to the motor, which stresses the components of the frequency converter, such as the power semiconductors, a lot more than necessary. For this reason, when it detects a large imbalance position of the loading, the group control unit 25 elects the reference to be used for the closing current of the brake such that the closing delay of the brake is minimized, in which case the brake closes more quickly.

FIG. 2 presents a schematic diagram of a brake 1 according to the invention. The electromechanical brake 1 comprises a magnetic circuit, which comprises at least two ferromagnetic parts 44, 44' fitted to move in relation to each other. Of the parts, the first 44 is fixed to the stationary part (not in figure) of the elevator machine, and the second 44' part is attached to the brake pad 42, which is fitted to connect to the braking surface 45. In this case a thrusting force is exerted between the ferromagnetic parts 44, 44' via two helical springs 41, 41', which thrusting force presses the brake pad 42 against the braking surface 45. An excitation winding 15 is wound around the first part 44 of the iron core of the magnetic circuit of the brake 1. The current supply to the excitation winding 15 produces a force of attraction between the ferromagnetic parts 44,44', in which case when the current and at the same time the force of attraction progressively increase, the second part 44' of the magnetic circuit finally starts to move towards the first part 44, pulling at the same time the brake pad 42 away from the braking surface 45. The air gap 43 of the magnetic circuit between the first 44 and the second 44' part starts to decrease, and finally goes to zero when the magnetic circuit closes. At the same time the brake opens, and the traction sheave can rotate. Correspondingly, when the current of the excitation winding progressively decreases, the second part 44' of the magnetic circuit finally starts to move away from the first part 44, pressing at the same time the brake pad 42 against the braking surface 45. In this case the brake closes to prevent movement of the traction sheave.

The arrangement according to FIG. 2 also comprises an electricity supply circuit 16 of the brake, which comprises a controllable switch 17, e.g. a relay, a MOSFET transistor, and/or an IGBT transistor, for adjusting the current of the excitation winding 15. A microcontroller 46 is fitted in connection with the control pole of the controllable switch 17, which microcontroller adjusts the measured current of the excitation winding 15 towards the selected current reference 11, 12, 13, 14 by connecting the controllable switch 17 with short pulses.

FIG. 3 presents some references for the energizing current and closing current of the brake according to the invention, with which different operating delays of the brake are achieved. These types of brake current references can be used e.g. in connection with the embodiment of FIG. 1. The first reference 11*a* of the energizing current of the brake presented in FIG. 3*a* is during the whole time of the energizing movement greater than when the energizing movement starts 18, whereas the second reference 12*a* of the energizing current of the brake is during the whole energizing movement smaller than when the energizing movement starts 18. In this case also the operating delay 11*a*, i.e. the time taken 19*a* for the energizing movement, according to the first reference 11*a* for energizing current is shorter than the operating delay 20*a* according to the second reference 12*a* for energizing current. The starting moment 18 of the energizing movement can be determined e.g. from the change in the brake current and/or brake voltage; on the other hand the starting moment can also be determined e.g. by means of a position switch that measures the position of the brake, by means of a distance meter, or in some other corresponding way. The first reference 11*b* of the closing current of the brake presented in FIG. 3*b* is during the whole time of the closing movement smaller than when the closing movement starts 18, whereas the second reference 12*b* of the closing current of the brake is during the whole time of the closing movement greater than when the closing movement starts 18. In this case the closing delay 19*b*, i.e. the time taken for the closing movement, according to the first reference 11*b* for closing current is shorter than the closing delay 20*b* according to second reference 12*b* for closing current. The starting moment 18 of the closing movement can be determined using the same measurement principles and/or measuring apparatuses as in the determination of the starting moment of the energizing movement.

FIGS. 4*a* and 4*b* present two different electricity supply circuits 16 of a brake according to the invention.

The electricity supply circuit of the brake according to FIG. 4*a* comprises a controllable switch 17, via which the excitation winding 15 is connected to a rectified voltage supply 33, in which case the current flowing through the excitation winding starts to increase, and the brake finally energizes. Correspondingly when the switch 17 is opened, the excitation winding 15 disconnects from the voltage supply 33, and the current of the winding commutates to the attenuation circuit connected in parallel with the winding, in which case the current starts to decrease with the time constant set by the inductance and the internal resistance of the winding, as well as by the impedance of the attenuation circuit. By connecting the controllable switch 17 with short pulses, e.g. with pulse width modulation, the brake current can thus be adjusted towards the selected reference for current. In one embodiment of the invention the adjustment of current can be implemented so that the controllable switch 17 is connected with short pulses only in connection with a closing movement and an energizing movement of the brake, and the switch 17 is otherwise kept continuously in the same switching state. This type of control reduces both the switching losses of the switch 17 and also the losses of the attenuation circuit.

The electricity supply circuit 16 of the brake according to FIG. 4*b* comprises four controllable switches, such as IGBT or MOSFET transistors, which are arranged into an H-bridge. Antiparallel-connected diodes are in parallel with the controllable switches. The excitation winding 15 of the brake is connected to the outputs of the change-over switches of the H-bridge according to FIG. 4*b*. Likewise the switches of the change-over switch are controlled in turns to conduct with PWM modulation (pulse width modulation), for adjusting the voltage between the poles of the excitation winding 15. In this embodiment of the invention the current of the excitation winding is measured, and the current is controlled with a current regulator, according to a selected brake current reference.

FIG. 5 presents the selection of a brake current reference 11, 12, 13, 14 as a block diagram. A plurality of optional objectives 3, 4, 5, 6 of operation are determined for the elevator, of which at least one at a time is selected to be implemented as an objective 3', 4', 5', 6' of operation. The selection is made using selection criteria, which can be derived directly or indirectly from different parameters that describe the operating state of the elevator system; e.g. the loading state 9 of the elevator can be derived from the load weighing data of the elevator car, the magnitude 8 of the traffic flow of the elevator can be derived from the time of use of the elevator, the amount of elevator calls, the load weighing data of the elevator car and from information produced by different access control apparatuses; also the permitted noise level of the elevator can be derived from the time of use 7, and the noise level can also e.g. be measured with microphones fitted in the elevator car or in the elevator hoistway.

The brake current reference 11, 12, 13, 14 used at any given time is selected according to an objective 3', 4', 5', 6' of the operation of the elevator to be implemented such that the selected brake current reference best corresponds to the objective of the operation of the elevator to be implemented It is obvious to the person skilled in the art that different embodiments of the invention are not limited to the example described above, but that they may be varied within the scope of the claims presented below.

The magnetic circuit of a brake presented in FIG. 2 is only an example; it is obvious to the person skilled in the art that the effect according to the invention can be achieved with different geometries of the magnetic circuit.

The invention claimed is:

1. A method for controlling a brake of an elevator, in which method:

determining a plurality of optional objectives of operation for the elevator;

selecting one or more of these objectives at a time to be implemented as an objective of the operation of the elevator by using selection criterion;

determining brake current references for an energizing current of the brake of the elevator that differ from each other and/or brake current references for a closing current of the brake of the elevator that differ from each other, wherein an operating delay of the brake corresponding to each of the references for the energizing current of the brake of the elevator differs from each other, and an operating delay of the brake corresponding to each of the references for the closing current of the brake of the elevator differs from each other;

selecting brake current reference used at any given time from the brake current references so that the selected brake current reference best corresponds to an objective of the operation of the elevator to be implemented;

controlling the brake of the elevator by adjusting brake current towards the selected brake current reference.

2. The method according to claim 1, wherein the controlling steps comprises:

measuring a current of an excitation winding of the brake;

adjusting the measured current towards the brake current reference for the excitation winding by connecting a controllable switch in an electricity supply circuit of the brake with short pulses.

3. The method according to claim 1, wherein:

a first one of the brake current references of the energizing current of the brake is determined so that the first one of the brake current references for the energizing current is during an energizing movement at least a part of the time greater than when the energizing movement starts;

a second one of the brake current references of the energizing current of the brake is determined so that the second one of the brake current references for the energizing current is during the whole time of the energizing movement smaller than when the energizing movement starts.

4. The method according to claim 1, wherein:

a first one of the brake current references of the closing current of the brake is determined so that the first one of the brake current references for the closing current is during a closing movement at least a part of the time smaller than when the closing movement starts;

a second one of the brake current references of the closing current of the brake is determined so that the second one of the brake current references for the closing current is during the whole time of the closing movement greater than when the closing movement starts.

5. The method according to claim 3, wherein:

the operating delay of the brake corresponding to the second one of the brake current references of the energizing current of the brake is longer than the operating delay corresponding to the first one of the brake current references of the energizing current of the brake.

6. The method according to claim 5, wherein:

the operating delay of the brake corresponding to a third one of the brake current references of the energizing current of the brake is longer than the operating delay corresponding to the second one of the brake current references of the energizing current of the brake.

7. The method according to claim 1, wherein:

a determined loading of the elevator is used as one selection criterion of an objective of the operation of the elevator.

8. The method according to claim 1, wherein:

a time of use of the elevator is used as one selection criterion of an objective of the operation of the elevator.

9. The method according to claim 1, wherein:

a magnitude of a traffic flow to be handled is used as one selection criterion of an objective of the operation of the elevator.

10. An elevator system comprising an arrangement for controlling a brake of an elevator, wherein the arrangement comprises:

a control loop for adjusting the brake current of the elevator;

a plurality of optional objectives of operation of the elevator, wherein one or more of the objectives is selected at a time to be implemented as an objective of the operation of the elevator by using selection criteria;

brake current references for an energizing current of the brake of the elevator that differ from each other and/or brake current references for a closing current of the brake of the elevator that differ from each other, wherein an operating delay of the brake corresponding to each of the references for the energizing current of the brake of the elevator differs from each other, and an operating delay of the brake corresponding to each of the references for the closing current of the brake of the elevator differs from each other;

wherein a brake current reference used at any given time is selected from the brake current references so that the selected brake current reference best corresponds to an objective of the operation of the elevator to be implemented, and the brake of the elevator is controlled by adjusting the brake current towards the selected brake current reference.

11. The elevator system according to claim 10, wherein:

a first one of the brake current references of the energizing current of the brake is determined so that the first one of the brake current references for the energizing current is during an energizing movement at least a part of the time greater than when the energizing movement starts, a second one of the brake current references of the energizing current of the brake is determined so that the second one of the brake current references for the energizing current is during the whole time of the energizing movement smaller than when the energizing movement starts, and the operating delay of the brake corresponding to the second one of the brake current references of the energizing current of the brake is longer than the operating delay according to corresponding to the first one of the brake current references of the energizing current of the brake.

12. The elevator system according to claim 11, wherein the operating delay of the brake corresponding to a third one of the brake current references of the energizing current of the brake is longer than the operating delay corresponding to the second one of the brake current references of the energizing current of the brake.

13. The elevator system according to claim 10, wherein a determined loading of the elevator is used as one selection criterion of an objective of the operation of the elevator.

14. The elevator system according to claim 10, wherein a time of use is used as one selection criterion of an objective of the operation of the elevator.

15. The elevator system according to claim 10, wherein a magnitude of a traffic flow to be handled is used as one selection criterion of an objective of the operation of the elevator.

16. The method according to claim 2, wherein:

the first reference of the energizing current of the brake is determined so that the reference for energizing current is during the energizing movement at least a part of the time greater than when the energizing movement starts the second reference of the energizing current of the brake is determined so that the reference for energizing current is during the whole time of the energizing movement smaller than when the energizing movement starts.

17. The method according to claim 2, wherein:

a first one of the brake current references of the energizing current of the brake is determined so that the first one of the brake current references for the energizing current is during an energizing movement at least a part of the time greater than when the energizing movement starts;

a second one of the brake current references of the energizing current of the brake is determined so that the second one of the brake current references for the energizing current is during the whole time of the energizing movement smaller than when the energizing movement starts.

18. The method according to claim 3, wherein:

a first one of the brake current references of the closing current of the brake is determined so that the first one of the brake current references for the closing current is during a closing movement at least a part of the time smaller than when the closing movement starts;

a second one of the brake current references of the closing current of the brake is determined so that the second one of the brake current references for the closing current is during the whole time of the closing movement greater than when the closing movement starts.

19. The method according to claim 17, wherein:

the operating delay of the brake corresponding to the second one of the brake current references of the energizing current of the brake is longer than the operating delay corresponding to the first one of the brake current references of the energizing current of the brake.

20. The method according to claim 18, wherein:

the operating delay of the brake corresponding to the second one of the brake current references of the energizing current of the brake is longer than the operating delay corresponding to the first one of the brake current references of the energizing current of the brake.

* * * * *